United States Patent [19]

Jeannet et al.

[11] 4,090,352

[45] May 23, 1978

[54] REDUCING GEAR-TRAIN OF AN ELECTRONIC WATCH WITH ANALOG DISPLAY

[75] Inventors: Pierre M. Jeannet, Chambrelien; Michel Girardin, La Chaux-de-Fonds, both of Switzerland

[73] Assignee: Devhorl S.A., Switzerland

[21] Appl. No.: 715,829

[22] Filed: Aug. 19, 1976

[30] Foreign Application Priority Data

Aug. 20, 1975 Switzerland ..... 11310/75

[51] Int. Cl.[2] ..... G04B 13/02; G04B 19/02; G04C 3/00

[52] U.S. Cl. ..... 58/23 D; 58/7; 58/59; 58/125 R; 58/138; 58/139

[58] Field of Search ..... 58/2, 7, 59, 125 R, 58/138, 139, 23 D

[56] References Cited

U.S. PATENT DOCUMENTS

| | | | |
|---|---|---|---|
| 2,898,730 | 8/1959 | Bamat | 58/59 |
| 2,981,055 | 4/1961 | Froidevaux et al. | 58/59 X |
| 3,534,545 | 10/1970 | Oster et al. | 58/7 X |
| 3,754,390 | 8/1973 | Maeda et al. | 58/7 |
| 3,792,578 | 2/1974 | Hetzel | 58/23 D |
| 3,888,073 | 6/1975 | Kurita | 58/7 |
| 4,047,376 | 9/1977 | Marz | 58/23 D |

FOREIGN PATENT DOCUMENTS

| | | | |
|---|---|---|---|
| 864,358 | 4/1941 | France | 58/7 |

*Primary Examiner*—Stanley J. Witkowski
*Attorney, Agent, or Firm*—Robert E. Burns; Emmanuel J. Lobato; Bruce L. Adams

[57] ABSTRACT

The reducing gear train of an electronic watch with analog display comprises a driving pinion of a step-by-step motor, a second wheel and pinion, a third wheel and pinion and a great wheel. A cannon pinion non-coaxially mounted in relation to the great wheel meshes with an intermediate wheel meshing with a great-wheel-arbor pinion frictionally coupled to the great wheel.

4 Claims, 2 Drawing Figures

FIG. 1
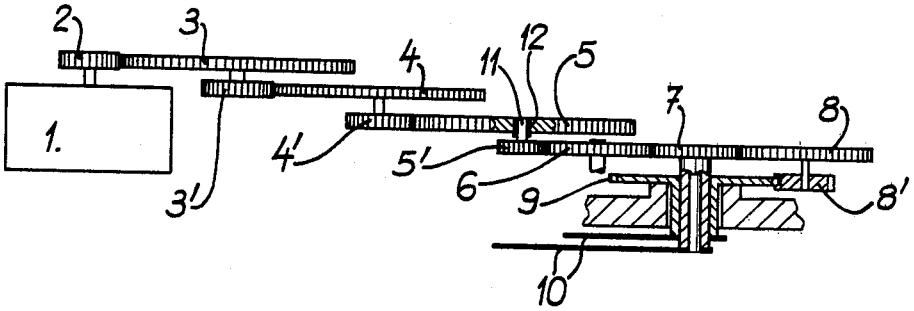
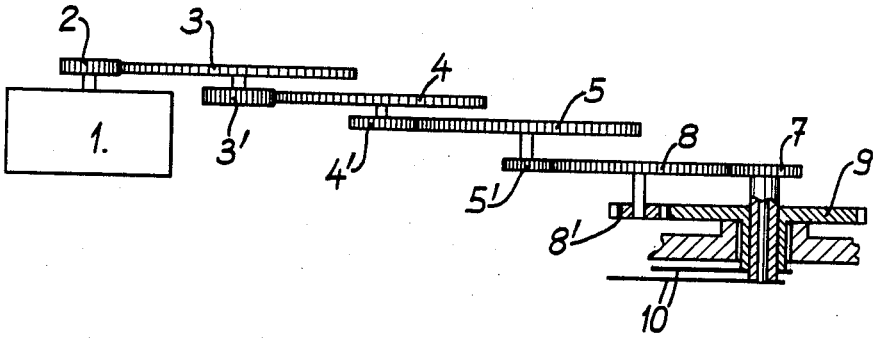
FIG. 2

REDUCING GEAR-TRAIN OF AN ELECTRONIC WATCH WITH ANALOG DISPLAY

BACKGROUND OF THE INVENTION

The invention relates to reducing gear-train of watches having an analog display driven by a step-by-step motor whose control frequency is a fraction of a minute, for example a second.

As known, such watches are generally equipped with a reducing gear-train having a driving pinion meshing with a second wheel having a second pinion meshing with a third wheel which in turns has a pinion meshing with a centrally-disposed great wheel or "centre-wheel." The latter wheel, which serves for the display of minutes, makes one revolution per hour, it being understood that the wheels and pinions of the same name are solidly fixed and coaxial.

As known, display of the hour is obtained by means of a plane differential gear train having, coaxially with the great or "centre" wheel, a cannon-pinion meshing with a dial-train wheel having a pinion which meshes with an hours wheel, which is also coaxial with the centre wheel.

To permit setting of the time, when the dial train is directly driven by the user (by means of a time-setting stem) and to avoid the entire great-train from being driven, a friction clutch is provided between the cannon pinion and the centre-wheel arbor. This is generally achieved by indenting the cannon pinion on the centre-arbor.

The most bulky element in any electronic watch with an anlog display is generally the energy source, i.e. the cell. To obtain the movement with as small a diameter as possible, for example a movement for ladies watches, the manufacturer is led to place the cell as close as possible to the centre. Because of this, with a gear-train such as that previously described, two wheels must pass under or over the cell, which necessarily brings the height of the movement to a value incompatible with an elegant exterior.

So as to alleviate this disadvantage, there have been proposals for cells of non-circular shape and dimensioned to enable two central wheels to pass beside the cell; this arrangement has enabled movements of small dimensions which can be fitted in shaped ladies cases to be obtained. To the contrary, for round exteriors, the benefit of this construction is lost and round exteriors are generally too large for ladies watches.

Another disadvantage of the previously described reduction train is the fact that by three gear trains one must obtain a great reduction which, in surface area, is also incompatible with a ladies watch movement of small dimensions having pinions which must remain within dimensions (module and diameter, compatible with mass production.

By way of example, with a motor supplied at 1 Hz and having 8 steps per rotation, the reduction that must be obtained for the minutes arbor (centre wheel) is 1/450.

SUMMARY OF THE INVENTION

To obviate the stated drawbacks, the present invention provides a reducing gear-train of an electronic watch with an analog display, comprising a driving pinion, a second wheel and pinion, a third wheel and pinion, a great wheel, and a cannon pinion non-coaxially mounted in relation to the great wheel, the cannon pinion and great-wheel arbor being coupled by an intermediate wheel meshing with a pinion solid with the great-wheel arbor, and the speed ratio between the great-wheel arbor and the cannon pinion being greater than one.

BRIEF DESCRIPTION OF THE DRAWING

The accompanying drawings show, by way of example, two embodiments of the invention.

FIG. 1 schematically shows a first embodiment and FIG. 2 schematically shows another embodiment.

DESCRIPTION OF THE PREFERRED EMBODIMENTS

The watch movement shown in FIG. 1 comprises a step-by-step electric motor 1, a driving pinion 2 fixed on the motor shaft, pinion 2 meshing with a second wheel 3 carrying a pinion 3' which meshes with a third wheel 4 whose arbor carries a pinion 4' meshing with a great or "centre" wheel 5. A pinion 5' fixed on the great-wheel arbor meshes with an intermediate wheel 6 which also meshes with a cannon pinion 7 meshing, as known, with a dial-train wheel 8 which by the intermediary of its pinion 8' transmits its rotation to an hours wheel 9. The cannon pinion 7 is positioned eccentrically of the axis of rotation of the great wheel 5.

The gear ratios are calculated so that the cannon pinion 7, which carries a minute-hand, makes one revolution per hour whereas the cannon or hours wheel 9, which carries an hour-hand on a pipe, makes one revolution per 12 hours. As a variation, while retaining the same speed of rotation of the cannon pinion 7 and the cannon wheel 9, the gear train may be arranged so that the second wheel 3 makes one revolution per minute and displays the seconds by an off-centre seconds-hand. So as to permit time-setting of the hands 10, without driving the entire gear train, a friction clutch 12 is provided between the great-wheel pinion 5' carried by the great-wheel arbor 11 and the great wheel 5. Each of the pinions is concentric with its respective corresponding gear wheel.

FIG. 2 schematically shows a second embodiment comprising a motor 1, a driving pinion 2 meshing with second wheel 3 which by its pinion 3' meshes with the third wheel 4 whose arbor has a pinion 4' meshing with the great wheel 5. The great-wheel arbor is connected to the great wheel 5 by a friction clutch. This arbor carries a pinion 5' driving a dial-train wheel 8 which acts as an intermediate wheel between pinion 5' and cannon pinion 7. The rotational movement of the dial-train wheel 8 is transmitted by its pinion 8' to the cannon wheel 9. As previously, the reducing gear ratio is calculated and arranged so that the hands 10 display the hours and minutes. In this embodiment, the dial-train wheel 8 thus has a dual purpose, on the one hand as intermediate wheel between the great-wheel pinion 5' and the cannon pinion 7 which gives the display of minutes and, on the other hand, as known, to drive the hours-displaying cannon wheel 9 via pinion 8'.

The described arrangements of the gear train offer the advantage of providing a reduction ratio less than one between the great-wheel pinion 5' and the cannon pinion 7, which reduces the reduction ratio between the shaft of motor 1 and the great-wheel arbor. This notably enables a reduction of the surface area of the three first reduction trains of the gear train, i.e. between the motor and the great-wheel arbor. By way of example, for a total reduction between the motor and the arbor carrying the minutes hand of 1/450 (as per the previously cited example), one may easily provide a ratio of ½ between the great wheel 5' and cannon pinion 7, which reduces the division ratio between the motor and the great-wheel arbor from 1/450 to 1/225. The effect of this reduction and, as in the second embodiment, the use of the dial-train wheel 8 as intermediate wheel between the great-wheel pinion 5' and cannon pinion 7, enable a gear train of particularly small surface area to be provided, while keeping pinions of acceptable size. Both gear-train arrangements have only a single wheel 9 in the centre placed under the dial. It is thus possible, without increasing the total height, to lodge the projecting edge of this wheel in an annular space or indent in the supply cell between the positive pole forming the cell casing and the negative pole of smaller diameter, most conventional cells having such a space or indent. Because of this, the cell can be placed close to the centre which enables the provision of small dimensions, both as regards the outer diameter and the thickness.

What is claimed is:

1. A reducing gear-train, for use in an electronic watch having an analog display, comprising: a driving pinion mounted for rotation; a second gear wheel having a pinion concentric therewith and mounted to rotate therewith, wherein said second wheel is positioned to engage with and is driven by said driving pinion; a third gear wheel having a pinion concentric therewith and mounted to rotate therewith, wherein said third wheel is positioned to engage with and is driven by said second wheel pinion; a great gear wheel having a pinion concentric therewith and mounted to rotate therewith, wherein said great wheel is positioned to engage with and is driven by said third wheel pinion; an intermediate gear wheel positioned to engage and be driven by said great wheel pinion; and a cannon pinion positioned eccentrically of an axis of rotation of said great wheel and positioned to engage and be driven by said intermediate wheel, wherein said intermediate wheel is dimensioned to define a ratio of rotational speed between said great wheel and said cannon pinion greater than one.

2. A reducing gear-train according to claim 1, wherein said intermediate wheel is a dial train gear wheel.

3. A timepiece movement, comprising: an electric stepping motor having a driving pinion; three gear wheels respectively designated a second wheel, a third wheel, and a great wheel each having a respective pinion concentric therewith and mounted to rotate therewith, wherein said second wheel engages and is driven to rotate by said driving pinion, said third wheel engages and is driven to rotate by said second wheel pinion, and said great wheel engages and is driven to rotate by said third wheel pinion; means comprising a friction clutch for coupling said great wheel and said great wheel pinion to permit said great wheel pinion to rotate relative to said great wheel when a sufficiently strong force is applied to rotate said great wheel pinion; a cannon pinion and a cannon gear wheel concentric with said cannon pinion and mounted to rotate relative to said cannon pinion; analog time-indicating members respectively carried on said cannon pinion and said cannon gear wheel for indicating time as said cannon pinion and said cannon gear wheel rotate; and an intermediate wheel engaging said great wheel pinion and said cannon pinion for positioning said cannon pinion eccentrically of said intermediate wheel and for rotating said cannon pinion in response to rotation of said great wheel pinions, wherein said intermediate wheel is dimensioned to define a reduction ratio greater than one between said great wheel and said cannon pinion.

4. A timepiece movement according to claim 3, wherein said intermediate wheel is a dial train wheel including a pinion concentric therewith and mounted to rotate therewith, and wherein said cannon wheel engages with and is driven to rotate by said dial train wheel pinion.

* * * * *